United States Patent [19]

Suttles et al.

[11] Patent Number: 4,662,093

[45] Date of Patent: May 5, 1987

[54] PHOTOGRAPH CARRYING POSTCARD

[76] Inventors: Cameron Suttles; Karen C. Madsen, both of 5750 SW. Hewett Blvd., Portland, Oreg. 97221

[21] Appl. No.: 748,346

[22] Filed: Jun. 24, 1985

[51] Int. Cl.[4] ..... G09F 1/10

[52] U.S. Cl. ..... 40/158 R; 40/159; 40/594; 40/10 R; 229/92.8

[58] Field of Search ..... 229/92.8; 40/10 R, 158 R, 40/159, 594, 158

[56] References Cited

U.S. PATENT DOCUMENTS

| | | | |
|---|---|---|---|
| 2,832,163 | 4/1958 | Jost | 40/158 R |
| 2,926,444 | 3/1960 | Atkins | 40/158 R |
| 2,952,930 | 9/1960 | Hartle et al. | 40/158 R |
| 3,024,553 | 3/1962 | Rowley | 40/158 R |
| 4,048,740 | 9/1977 | Zitzelberger et al. | 40/158 R |
| 4,057,923 | 11/1977 | Chase | 40/158 R |
| 4,079,881 | 2/1978 | Sabb | 40/158 R |
| 4,332,095 | 1/1982 | Tanney | 40/158 R |
| 4,531,316 | 7/1985 | Farnum | 40/158 R |

*Primary Examiner*—Gene Mancene
*Assistant Examiner*—Wenceslao J. Contreras
*Attorney, Agent, or Firm*—Eugene M. Eckelman

[57] ABSTRACT

First and second panels are connected by a hinge joint for folding together. The front surface of the first panel is capable of receiving a design and the rear surface thereof has a paper release sheet covering a pressure sensitive adhesive which holds the photograph in place and also holds the card in folded condition. The front surface of the second panel is a support surface for a photograph and includes a small area of pressure sensitive adhesive for temporarily holding a photograph in place. The rear surface of the second panel comprises a message-address postcard surface. An opening cut through the first panel is arranged to display a photograph therethrough when the panels are folded shut and held shut by the adhesive on the rear surface of the first panel. The front surface of the second panel has locators thereon for properly positioning a photograph to be displayed in the opening.

2 Claims, 5 Drawing Figures

PHOTOGRAPH CARRYING POSTCARD

BACKGROUND OF THE INVENTION

This invention relates to new and useful improvements in photograph carrying postcards.

Devices have heretofore been conceived for mailing postcards to which a photograph has been attached. One particular fault of these prior devices is that it is difficult to place the photograph therein so that it is precisely located in an opening provided in the card. More particularly, the cards are constructed with one of the panels having a removable window opening therein, and a pressure sensitive adhesive is provided on the back side for holding the photograph in place and also for holding panels of the card together. With pressure sensitive adhesive on the rear side of the face panel, it is difficult to view the photograph through a front surface while at the same time aligning and sticking the photograph onto the back side properly for framing by the opening. Also, as is known, photographs come in varying sizes and this makes it more difficult to align the photograph with the opening due to the fact that as stated applying the photograph must be accomplished from the back side.

SUMMARY OF THE INVENTION

According to the present invention and forming a primary objective thereof, a photograph carrying postcard is provided which has substantial improvements over devices heretofore known.

More particularly, an object of the invention is to provide a photograph carrying postcard designed to facilitate convenient and accurate folding and also to facilitate accurate positioning of a photograph, thus not only more accurately allowing a photograph to be positioned relative to an opening in the card but also to allow the assembly of the photograph and card in a very short time.

Another object is to provide a device which permits construction thereof by an improved method.

In carrying out the invention, first and second panels of the postcard are connected by a hinged joint whereby in a folded condition of the postcard the rear surface of the first panel overlies the front surface of the second panel. The front surface of the first panel comprises a facing surface capable of receiving a decorative design and the rear surface thereof has a paper release sheet concealing pressure sensitive adhesive on such rear surface. The front surface of the second panel comprises a support surface for a photograph and includes temporary attaching means which allow a photograph to be initially attached in alignment with an opening cut through the first panel. When the panels are folded together on the hinged joint, a pressure sensitive adhesive on the rear surface of the first panel, upon removal of the paper release sheet, securely holds the photograph in place relative to the opening in the first panel. The front surface of the second panel includes locating means to properly align a photograph for display through the opening.

The invention will be better understood and additional objects and advantages will become apparent from the following description taken in connection with the accompanying drawing.

DETAILED DESCRIPTION OF A PREFERRED EMBODIMENT

Figure 1:
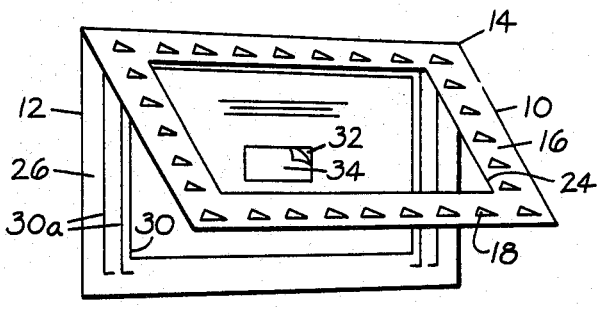
FIG. 1 is a perspective view of the present postcard in a partially folded condition prior to installing a photograph in it.
Figure 2:
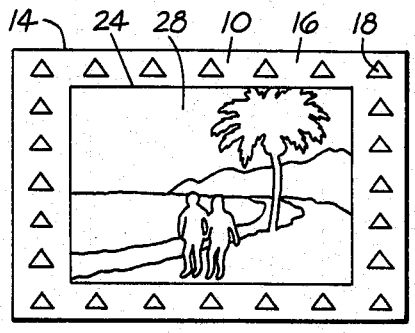
FIG. 2 is a front view of the card in a folded and completed form enclosing a photograph in it.
Figure 4:
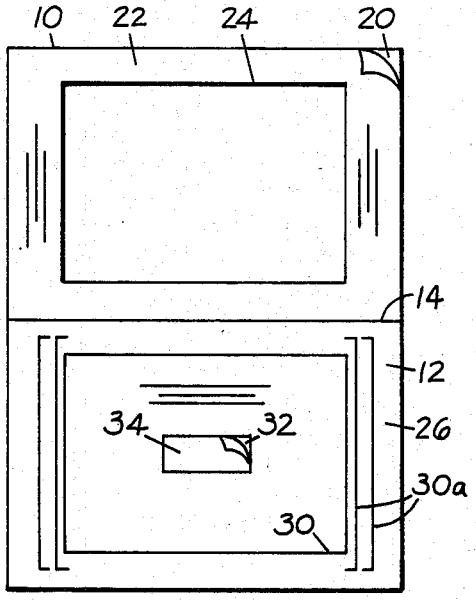
FIG. 4 is a view of the card with the panels thereof folded out on the hinge joint and showing the panels in an initial step of construction.
Figure 5:
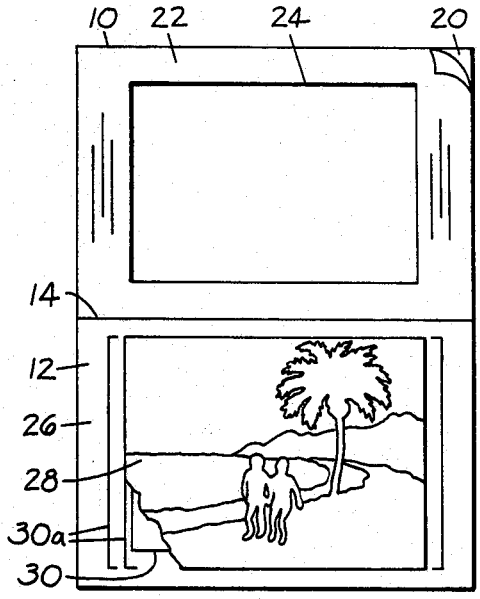
FIG. 5 is a view similar to FIG. 4 but showing the card in a further and completed step of construction prior to folding.

With particular reference to the drawings, the card comprises first and second panels 10 and 12 of identical size and joined by a hinge joint 14. This hinge may comprise a cross indentation or any other type of hinge structure that provides easy folding of the panels together and at the same time is of a structure to provide accurate folding of one panel on the other. The first panel 10 has a front surface 16 which may be provided with a suitable decoration 18 around the outer portion thereof. With reference to FIG. 4, the entire opposite side of the front surface 16 is provided with a pressure sensitive adhesive 20 covered by a paper release sheet 22. First panel 10 is provided with an opening 24 which as will be apparent comprises a viewing or frame opening for a photograph supported between the two panels when the card is folded, as in FIG. 1. In the manufacture of the card, the opening 24 is cut after the paper release sheet is applied. The card is thus furnished to the customer with the opening in it.

Figure 3:
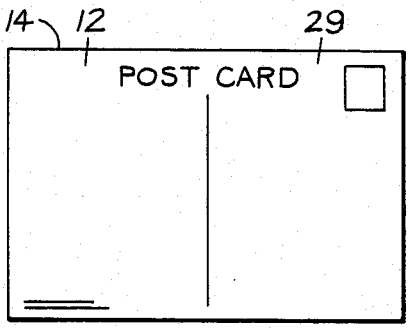
FIG. 3 is a rear view of the card.

The front surface 26 of the second panel 12 comprises a support surface for a photograph 28 and the rear surface 29 thereof comprises a message-postcard surface, FIG. 3.

Important to the invention, first locating means 30 are provided on the surface 26 of the second panel 12 for aligning a photograph with the opening 24. More particularly, this first locating means has an outer rectangular defining dimension substantially identical with the defining dimension of the opening 24 and precisely aligned with such opening when panel 10 is folded onto panel 12 so that a person when locating a photograph relative to the locating means 30 can be assured that a photograph will appear in the opening 24 when the panels are folded. Furthermore, auxiliary locating means 30*a*, which may be partial rectangles or full rectangles if desired, are provided outwardly of the first locating means and dimensioned according to conventional larger photograph sizes. Thus, with reference to the primary locating means 30 and the auxiliary locating means 30*a*, a person can precisely position a photograph according to the size thereof on surface 26 so as to appear in the window when the card is folded shut. Also important to the invention, a small area or patch 32 of pressure sensitive adhesive is provided on the surface 26 within the locating means 30 and such surface is covered with a paper release sheet 34. By means of this small adhesive area 32, a photograph can be temporarily located in place relative to the opening and if any shifting is required, the small adhesive area allows easy adjustment. This small adhesive section will hold the photograph in place while the card is being folded.

For the purpose of mounting a photograph in the card, the card is first opened to the FIG. 4 position, the paper release sheet 34 is removed, and the photograph pressed on adhesive 32 in guided relation by the primary locating means 30 and/or the auxiliary locating means 30*a*. With the photograph located in place by proper adjusting if necessary on the adhesive 32, the person's hands are free to complete the card, namely, the paper release sheet 22 can then be removed and the first panel 10 folded down onto the second panel. This frames the photograph and secures the two panels together in an integrated card structure. It is to be understood that the strip 34 does not have to be removed at first but instead the person can first line up a photograph with the opening down and then this strip can be released.

The structure of the present postcard facilitates manufacture by mass production. For example, printing of the card, forming of the hinge, cutting out the opening 24 and folding the card for packaging can be accomplished with a minimum number of steps. It is apparent that the steps of constructing the card can be accomplished by in-line methods to minimize costs of construction.

It is to be understood that the form of our invention herein shown and described is to be taken as a preferred example of the same and that various changes in the shape, size and arrangement may be resorted to without departing from the spirit of our invention on the scope of the subjoined claims.

Having thus described our invention, we claim:

1. A postcard for supporting a photograph therein comprising first and second panels having defining edges and being connected by a hinge joint at one of said edges whereby said first panel can be folded over onto said second panel, said first and second panels each having front and rear surfaces and being substantially the same size and shape, the rear surface of said first panel overlying the front surface of said second panel in a folded condition of said postcard, the front surface of said first panel comprising a facing surface capable of receiving a design, the entire rear surface fully to the defining edges of said first panel having a pressure sensitive adhesive thereon covered by a removable paper release sheet, the front surface of said second panel comprising a support surface for a photograph and including an intermediate patch of pressure sensitive adhesive and removable paper release sheet thereon, said patch of pressure sensitive adhesive and removable paper release sheet forming temporary attaching means holding a photograph thereon but shiftable if necessary, the rear surface of said second panel comprising a message-address postcard surface, and an opening cut through said first panel arranged in a folded condition of the panels to display a photograph therethrough which has been supported on the front surface of said second panel by said temporary attaching means and shifted on said temporary attaching means for aligned display in said opening, said pressure sensitive adhesive on the rear surface of said first panel, upon removal of said paper release sheet and folding said panels into said folded condition, securely holding said photograph in place and securely holding said panels integrally together at said edges and other overlying areas to form a postcard in said folded condition.

2. The postcard of claim 1 wherein said front surface of said second panel includes locating means thereon to properly align a photograph on said temporary attaching means for display through said opening in said first panel when the latter is folded onto said second panel, said locating means including aligning means of a size approximately outlining the defining edges of said opening for precisely locating a photograph with said opening in its temporarily held position, and auxiliary locating means designating positions for different sized photographs.

* * * * *